US006430822B1

(12) United States Patent
Slates

(10) Patent No.: US 6,430,822 B1
(45) Date of Patent: Aug. 13, 2002

(54) ARCHERY BOW SIGHT MOUNT WITH HORIZONTAL ADJUSTMENT OF THE SIGHT

(75) Inventor: Scott O. Slates, County of St. Charles, MO (US)

(73) Assignee: Toxonics Manufacturing, Inc., Wentzville, MO (US)

( * ) Notice: Subject to any disclaimer, the term of this patent is extended or adjusted under 35 U.S.C. 154(b) by 55 days.

(21) Appl. No.: 09/726,247

(22) Filed: Nov. 30, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 4,535,747 | A | * | 8/1985 | Kudlacek | 124/87 |
| 4,584,777 | A | * | 4/1986 | Saunders | 124/87 |
| 4,875,290 | A | * | 10/1989 | Finch | 33/265 |
| 5,072,716 | A | | 12/1991 | Sappington | |
| 5,174,269 | A | | 12/1992 | Sappington | |
| 5,379,746 | A | | 1/1995 | Sappington | |
| 5,406,712 | A | | 4/1995 | Slates | |
| 5,414,936 | A | | 5/1995 | Sappington | |
| 5,428,901 | A | | 7/1995 | Slates | |
| 5,495,675 | A | * | 3/1996 | Huang | 124/87 |
| 5,507,272 | A | * | 4/1996 | Scantlen | 124/87 |
| 5,509,402 | A | | 4/1996 | Sappington | |
| 5,524,601 | A | | 6/1996 | Slates et al. | |
| 5,630,279 | A | | 5/1997 | Slates | |
| 5,657,740 | A | | 8/1997 | Slates et al. | |
| 5,694,698 | A | | 12/1997 | Slates | |
| 5,722,175 | A | | 3/1998 | Slates | |

* cited by examiner

*Primary Examiner*—Diego Gutierrez
*Assistant Examiner*—Ryan T. Hayleck
(74) *Attorney, Agent, or Firm*—Paul M. Denk

(57) ABSTRACT

An archery bow sight is provided in which the sight mount includes a horizontal adjustment mechanism to adjust the horizontal position of the sight relative to the bow, in addition to the vertical position of the sight. Indicia are provided on the horizontal adjustment mechanism to determine the amount of adjustment that has been made to the sight.

7 Claims, 3 Drawing Sheets

ARCHERY BOW SIGHT MOUNT WITH HORIZONTAL ADJUSTMENT OF THE SIGHT

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This application relates to archery bow sights, and, more particularly to an archery bow sight including a horizontal adjustment which allows an archer to adjust the horizontal position of the sight as well as the vertical position of the sight.

Bow hunters typically use pin sights when hunting game. The pin sight includes at least one pin which is positioned on the bow and is used to aim at the target, such as a deer or a target. Before an archer hunts, the pin is positioned on the bow to indicate a certain distance, i.e., 100 yards. If the archer is to shoot at game at a different distance, the pin will have to be repositioned with respect to the bow, i.e., it will have to be moved vertically. Additionally, there are times when the pin has to be moved horizontally or laterally relative to the bow, to properly position the sight for use by an individual archer. In either of these instances, it is important that the pin remain generally perpendicular to the plane of the bow. On many bow sight mounts, when the pin is repositioned, the design of the mount does not ensure that the pin will remain in the desired perpendicular position.

U.S. Pat. Nos. 5,414,936, 5,524,601, 5,509,402, 5,657,740, 5,694,698, and 5,722,175, all of which are assigned to the same assignee of the current invention, and all of which are incorporated herein by reference, disclose pin mounts which maintain the pin perpendicular to the plane of the bow during vertical adjustment of the pin or sight. However, these prior patents do not disclose any method for conveniently moving the pin laterally. In U.S. Pat. No. 5,414,936, I disclose a pin mount which does move the pin laterally. However, the method of enabling lateral movement of the pin can be improved upon.

BRIEF SUMMARY OF THE INVENTION

An archery bow sight is provided in which the sight mount includes a horizontal adjustment mechanism to adjust the horizontal position of the sight relative to the bow, in addition to the vertical position of the sight. Indicia are provided on the horizontal adjustment mechanism to determine the amount of adjustment that has been made to the sight.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
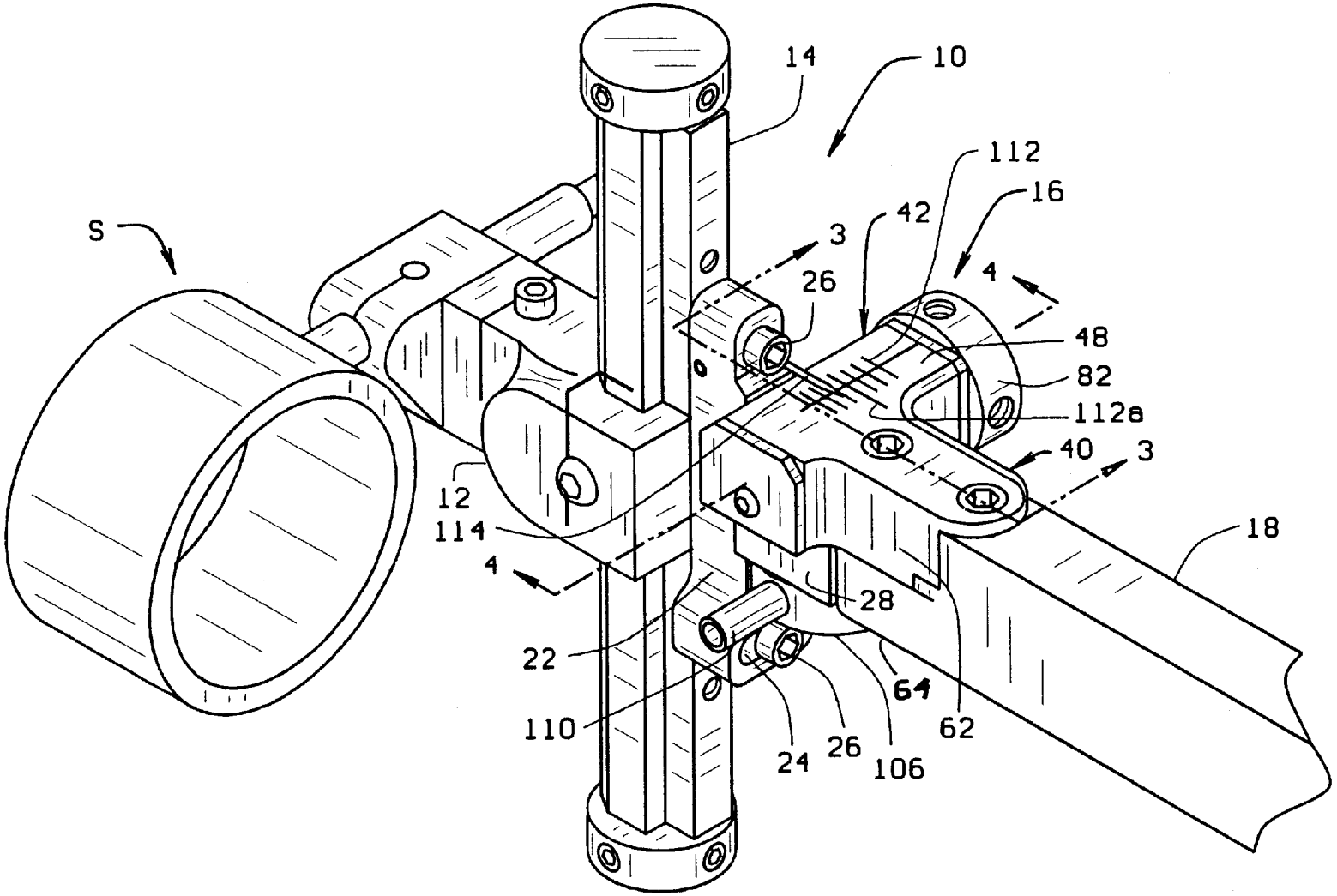
FIG. 1 is a perspective view of the bow sight mount of the present invention.

A bow sight assembly 10 is generally shown in FIG. 1. The assembly 10 includes a sight S which is mounted to a mounting block 12, which in turn is mounted to a generally vertical track to be movable vertically along the track 14. The sight 10 can be a pin sight, fiber optic sight, cross-hair sight, or any other desired type of sight. The mounting block 12, and its mounting to the track 14 can be accomplished an any number of ways, but is preferably constructed as set forth in one of my prior patents, U.S. Pat. Nos. 5,414,936, 5,524,601, 5,509,402, 5,657,740, 5,694,698, and 5,722,175, which are incorporated herein by reference.

The track or slide 14 is mounted to a two-piece horizontal adjustment mechanism 16, which in turn is mounted to an extension arm 18. The extension arm 18, as is known, is mounted to an archery bow.

The adjustment mechanism 16 includes first or forward portion 20 to which the track 14 is fixed. The forward portion 20 includes a generally vertically extending mounting plate or arm 22 having spaced apart holes 24. Bolts 26 extend through the holes 24 to screw into threaded holes 25 in the back of the track 14 to fix the track to the portion 20. The mounting arm 22 extends from the forward end a body 28. The body 28 has a top surface 30, back surface 32, side surfaces 34, and a bottom surface 36. A pair of generally V-shaped grooves 38 are formed from ribs 39 which extend up from the top surface 30 along the edges of the top surface 30, and extend between the side surfaces 34. Lastly, a through-hole 42*a* extends through the body 28, between the top and bottom surfaces 30 and 36, respectively. The forward portion 20, including the body 28 and the mounting arm 22, is preferably formed as a one-piece, unitary element.

Figure 2:
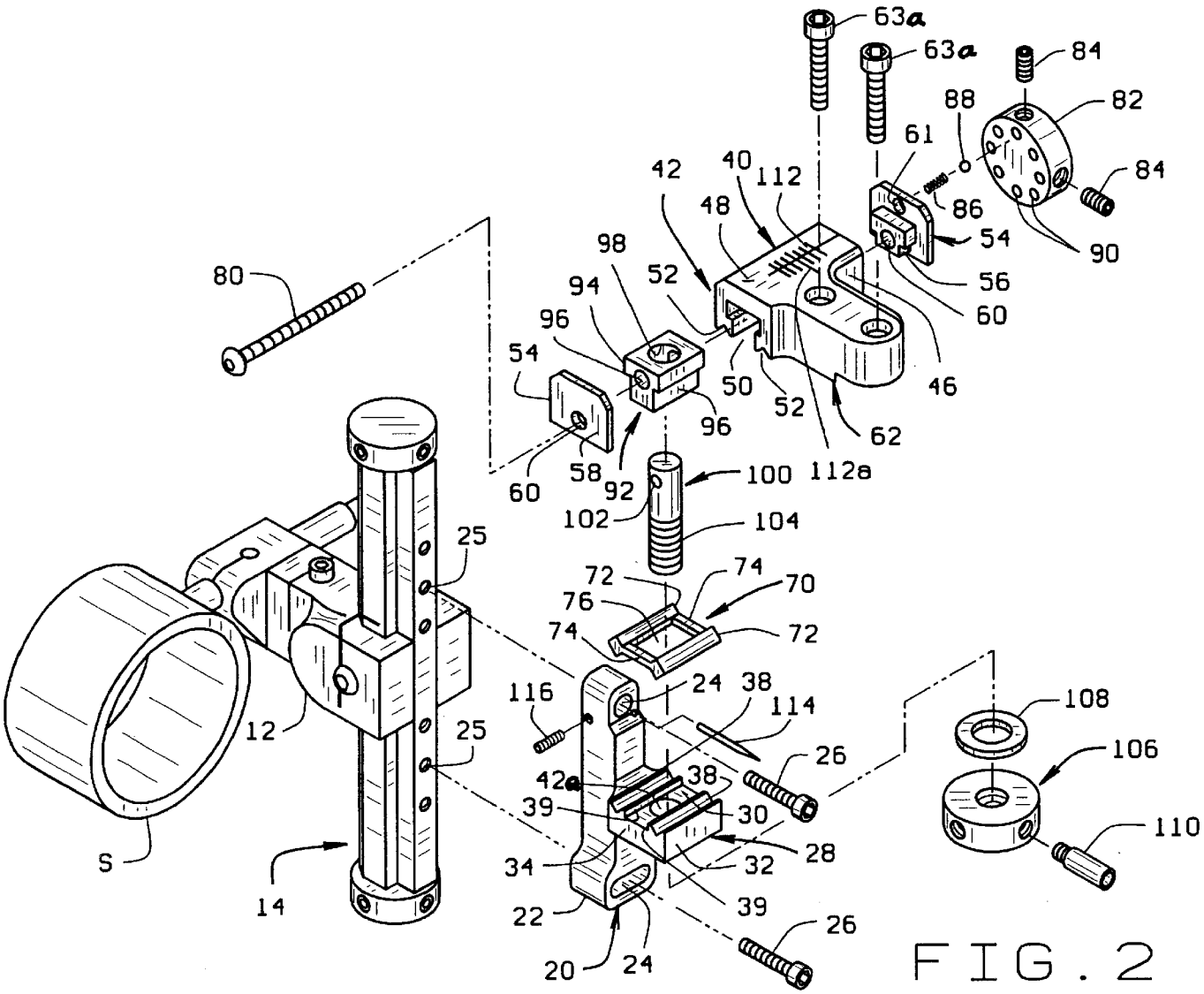
FIG. 2 is a exploded view of the bow sight mount of the present invention.
Figure 3:
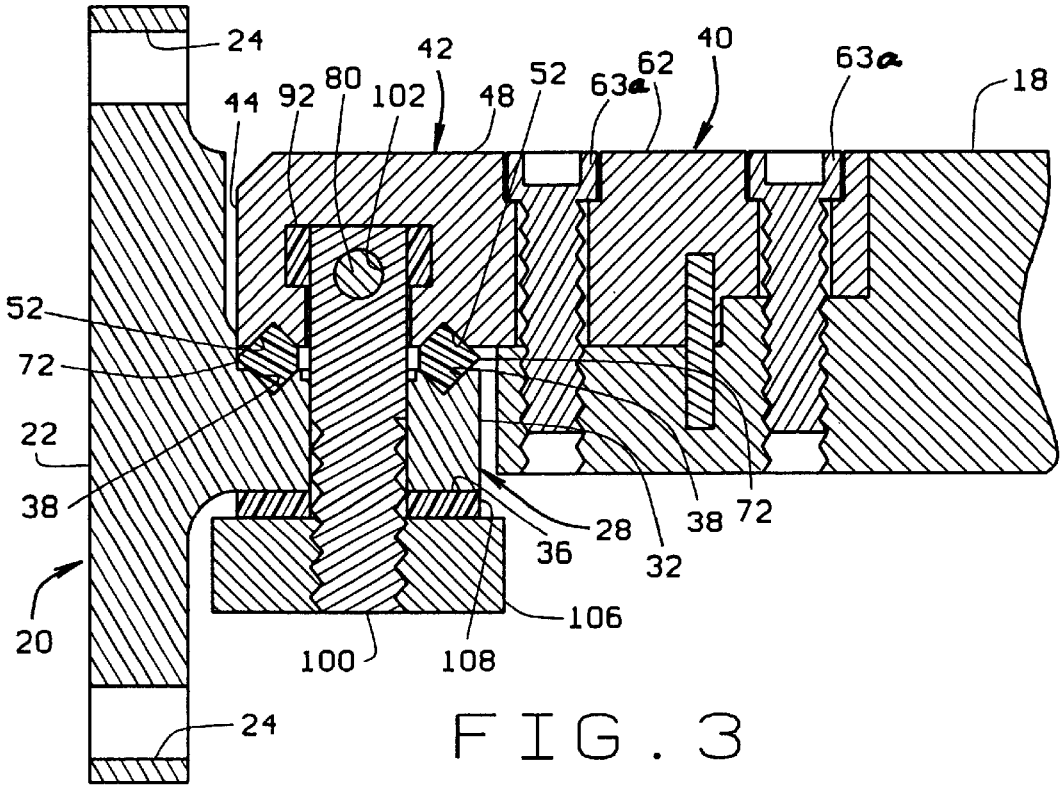
FIG. 3 is a horizontal cross-section of the bow sight mount.
Figure 4:
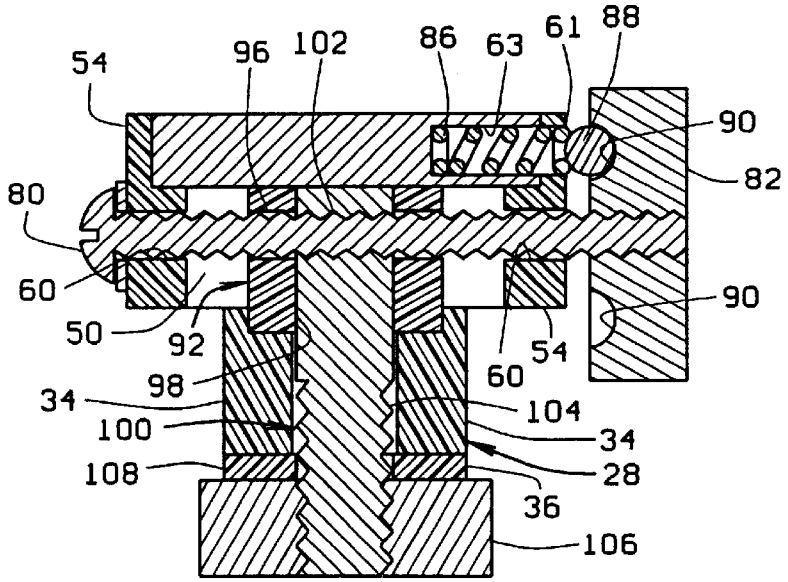
FIG. 4 is a vertical cross-section of the bow sight mount

The forward portion 20 of the assembly 16 is mounted to a second or back portion 40 to be slidable relative to the back portion in a direction perpendicular to the axis of the bow and of the track 14. The back portion 40 includes a horizontally extending track or slide 42 having a forward surface 44, a back surface 46, and a top surface 48 defining a downwardly opening channel 50. As seen best in FIG. 2, the channel 50 is preferably T-shaped. The back portion 40 does not include integral ends, and hence, the channel 50 is also open at its ends. The bottom edges of the forward and back walls 44 and 46, respectively, have generally V-shaped grooves 52 formed therein. Caps 54 close the ends of the track 42. The caps 54 are generally T-shaped in cross-section, and include an inner peg 56 which is sized and shaped to be received within the channel 50, and an outer surface 58 having a perimeter sized and shaped to correspond to the size and shape of the perimeter of the outer edges of the track 42. The caps 54 each have a central opening 60, the central opening 60 of the two caps being generally aligned with each other and with the channel 50, when the caps are received in the track 42. Additionally, one of the caps 54 has a second opening 61 near the top of the cap. A bore 63 is formed in the track 42 and the cap opening 61 is aligned with the track bore 63.

An 62 arm extends from the back surface 46 of the horizontal track 42. The arm 62 mates with the forward end 64 of the extension arm 18 to mount the back portion 40 to the arm 18. For example, the arm 62 and the extension arm 18 can be stepped, as and screws 63*a* can be used to fix the rear portion 40 of the adjustment mechanism 20 to the arm 18. The rear portion 40 can be fixed to the extension arm 18 in any other desired manner. Alternatively, the rear portion 40 and the extension arm 18 could be formed as a one-piece, unitary assembly. In either event, at least the rear portion 40, including the track 42 and the arm 62, is formed as a one-piece unitary member.

A slide plate 70 is positioned between the forward portion 20 and the rear portion slide 42. The slide plate 70 is preferably made of a material which will reduce the friction between the body 28 and the track 42 to facilitate smooth movement of the forward portion 20 relative to rear portion 40. For example, the slide plate 70 could be made of a plastic (such as nylon) or Teflon®. The slide plate 70 has a pair of generally parallel, generally diamond shaped rails 72 connected to each other by a pair of spaced apart connectors 74. The rails 72 are received in the grooves 38 and 52 of the first and second portions, respectively, of the adjustment mechanism 16. The inner edges of the rails 72 and the connectors 74 define a generally square hole 76. The hole 76 is generally aligned with the through hole 42*a* of the forward portion 20 and the channel 50 of the back portion 40 when the adjustment mechanism 16 is assembled. The distance between the inner edges of the rails 72 is preferably about equal to the width of the opening into the channel 50.

A threaded shaft 80 extends through the channel 50 of the adjustment mechanism back portion 40. A knob 82 is fixed to one end of the shaft 80 externally of the end cap 54. Set screws 84 can be threaded into the circumferential edge of the knob 82 to fix the knob 82 to the shaft 80. A spring 86 is received in the track hole 63 and a ball 88 is received between the spring 86 and a back face of the knob 82. The knob 82 has a plurality of spaced apart holes 90 into which the ball 88 partially fits. The spring biased ball 88 and the knob holes 90 allow for indexed rotation of the knob 82. As can be appreciated, because the knob 82 is fixed to the shaft 80, rotation of the knob 82 will cause the shaft 80 to rotate.

A generally T-shaped slide block 92 is received in the track channel 50. The slide block 92 includes cross member 94 and a stem 96 depending from the cross member 94. A threaded bore 96 extends horizontally between end surfaces of the block 92. The bore 96 is sized to threadedly receive the threaded shaft 80. As can be appreciated, rotation of the shaft 80 will cause the slide block 92 to move in the channel 50. The slide block 92 extends up through the hole 76 in the slide plate 72. Thus, the slide plate 72 will be moved by the slide block 92. The slide block 92 includes a second, vertical, hole 98 which intersects the horizontal threaded hole 94. A post 100 extends through the side block vertical hole 98 and extends below the bottom surface of the side block 92 to extend into, and beyond, the adjustment mechanism forward portion 20 to extend beyond the bottom surface of the adjustment mechanism forward portion. The post 100 has a hole 102 at its top, through which the threaded shaft 80 extends. The hole 102 can, but need not be, threaded. The post 100 is threaded, as at 104, at least along a top portion of the post 100. A knob 106 is received on the threaded end of the post 100, and is fixed to the post, for example, by the use of set screws. The knob 106 is adjacent the bottom 36 of the forward potion body 28. To reduce friction, a washer 108 is placed between the knob 106 and the body 28.

A lever 110 extends radially from the knob 106. The lever 110 is used to move the knob 106 between a first position, in which the knob is tightened down against the adjustment mechanism first portion, and a second position, in which the knob 106 is loosened. In the first, tightened, position, the knob 106 pulls the first and second portions of the adjustment mechanism together to prevent unwanted movement of the adjustment mechanism. On the other hand, when the knob 106 is moved to its loosened position, the adjusting knob 82 can be turned to move the adjustment mechanism forward portion 20 axially along the track 40. To gauge the amount of movement, and the position, of the forward portion 20 relative to the rear portion 40, the top surface 48 of the rear portion is provided with indicia 112. Preferably, one of the marks 112*a* is a zero mark. A needle or pointer 114 is provided which extends from the forward portion mounting arm 22 rearwardly over the rear portion top surface 48 to the marks 112. The pointer 114 is received in a hole in the forward portion mounting arm 22, and is secured in place using a set screw 116 which bears against the shaft of the pointer 114 in its hole.

As can be appreciated, the pin sight mounting assembly 10 provides not only for vertical movement of the sight S, in accordance with the patents noted above, but also provides for simple and easy horizontal adjustment of the sight S. Further, the provision of the indicia 112 allow the archer to measure or gauge the amount of horizontal adjustment that has been made to the sight to the left or right of the zero mark 112*a*. Any horizontal adjustment to the position of the sight S will be slight. Thus, the indicia 112 are preferably spaced apart in small increments, for example 1 mm or 1/32".

As various changes could be made in the above constructions without departing from the scope of the invention, it is intended that all matter contained in the above description or shown in the accompanying drawings shall be interpreted as illustrative and not in a limiting sense. For example, although the grooves 38 and 52 are generally triangular, and the slide rails 72 are generally diamond shaped, they could have alternative shapes. Alternatively, one of the groove of either forward and rear members can be replaced with a rib, and the rails 72 of the slide 70 can be generally V-shaped to receive the rib of one member and be received in the groove of the other member. For example, the grooves could be semicircular, and the rails 72 could be circular. Any other shape could also be used. The slide 70 could be eliminated, and either the first portion body 28 or the slide 40 could be provided with ribs that are received in the grooves of the opposing member. The locking knob 106 can be replaced with a cam which is movable between a position in which it bears down on the forward portion body 28 to substantially prevent movement of the forward portion relative to the rear portion, and a second position in which the cam is loose, and the first portion can be moved by rotation of the adjusting knob 82. These examples are merely illustrative.

What is claimed is:

1. An archery bow sight including a first slide operatively mounted to a bow, a second slide mounted to the first slide, and a sight operatively mounted to the second slide; the first slide being operable to adjust the horizontal position of the sight and the second slide being operable to adjust the vertical position of the sight;

the first slide comprising a first member which is operatively connected to said bow, a second member to which said second slide is mounted and which is slidable relative to said first member, and a lock; said lock being selectively moved between a locked position in which the relative location of said second member cannot be changed and an unlocked position in which the relative position of said second member can be changed;

said first member having a top and side walls defining a downwardly opening, horizontally extending channel;

a slide block received in said channel for axial movement relative to said channel; a threaded shaft extending the length of said channel and threadedly passing through said slide block such that rotation of said shaft will move said slide block relative to said channel; and a knob fixed to said shaft to rotate said shaft;

said second member including a body and a mounting plate on said body; said second slide being mounted to said mounting plate; said second member body being operatively connected to said first member slide block such that said second member will move with said first member as said threaded shaft is rotated.

2. The archery bow sight of claim 1 including a post extending downwardly from said slide block, said post extending through said second member, said lock comprising a member on said post which is movable between a first tightened position in which it forces said second member against said first member to substantially prevent relative movement of said first member relative to said second member and a second loosened position in which said second member can be moved relative to said first member.

3. The archery bow sight of claim 2 wherein said post is threaded at an end thereof, said lock member comprising a rotatable locking knob.

4. The archery bow sight of claim 1 including a guide on said first slide member; said guide comprising one of a groove and a rib on a bottom edge of at least one of said track side walls and the other of a rib and a groove operatively formed on an upper surface of said second member; said rib and groove engaging each other to substantially maintain a desired alignment of sight in a horizontal plane.

5. The archery bow sight of claim 4 including a slide plate positioned between first and second members; said slide plate having a rail sized and shaped to be received in the one of the rib and groove of the first member track.

6. The archery bow sight of claim 5 wherein said slide plate rails are generally diamond shaped; said first member track and said second member body both having grooves sized and shaped to receive the rails of the slide plate.

7. The archery bow sight of claim 1 including adjustment indicia on said first member top surface and a pointer extending from said second member; said pointer being alignable with the adjustment indicia to measure the amount of horizontal adjustment.

* * * * *